United States Patent [19]

Caruso

[11] Patent Number: 4,526,184

[45] Date of Patent: Jul. 2, 1985

[54] STEAMABLE HAIR CURLER

[76] Inventor: Richard Caruso, 7801 Montgomery Ave., Elkins Park, Pa. 19117

[21] Appl. No.: 582,248

[22] Filed: Feb. 22, 1984

[51] Int. Cl.[3] ..... A45D 2/02

[52] U.S. Cl. ..... 132/39; 132/33 G; 132/40

[58] Field of Search ..... 132/39, 40, 42 R, 33 R, 132/33 G

[56] References Cited

U.S. PATENT DOCUMENTS

| | | | |
|---|---|---|---|
| 1,504,567 | 8/1924 | MacDonald et al. | 132/33 R |
| 2,254,816 | 9/1941 | Bergmann | 132/33 R |
| 2,910,989 | 11/1959 | Russell | 132/42 R |
| 3,016,909 | 1/1962 | Schrock | 132/40 |
| 3,092,118 | 6/1963 | Otto et al. | 132/40 |
| 3,470,888 | 10/1969 | Kuhn | 132/40 |
| 3,572,350 | 3/1971 | Adams et al. | 132/39 |
| 3,616,804 | 11/1971 | Simoneaux | 132/40 |
| 3,759,271 | 9/1973 | Caruso | 132/33 G |
| 4,318,419 | 3/1982 | Puckett | 132/40 |
| 4,403,621 | 9/1983 | Paradise | 132/40 |

FOREIGN PATENT DOCUMENTS

| | | | |
|---|---|---|---|
| 1046846 | 12/1958 | Fed. Rep. of Germany | 132/42 R |
| 1099918 | 3/1955 | France | 132/42 R |

*Primary Examiner*—Gregory E. McNeill

*Attorney, Agent, or Firm*—Seidel. Gonda, Goldhammer

[57] ABSTRACT

A hair curler which includes a porous sleeve of foam plastic material surrounded by a perforated sleeve which is of more rigid material. The foam sleeve is closed at one end and open at the other end for receiving steam. The foam sleeve may be used with or without a core.

20 Claims, 14 Drawing Figures

FIG. 3
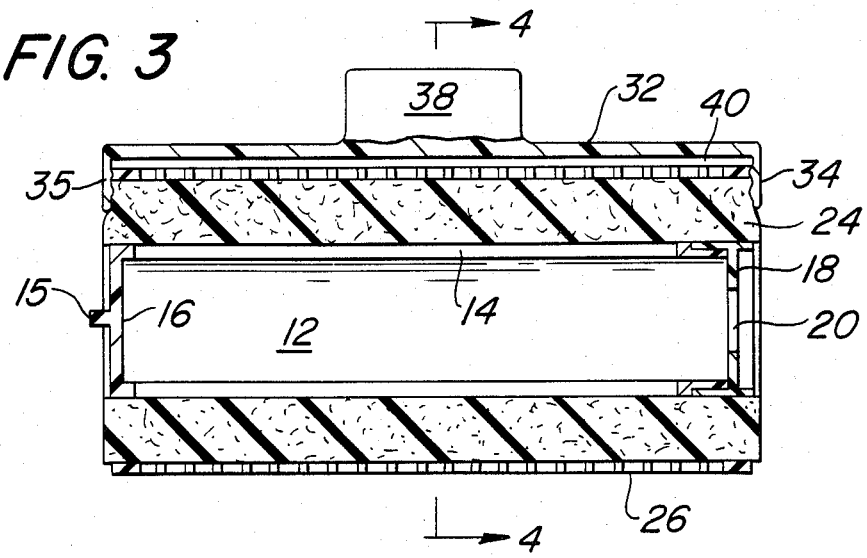
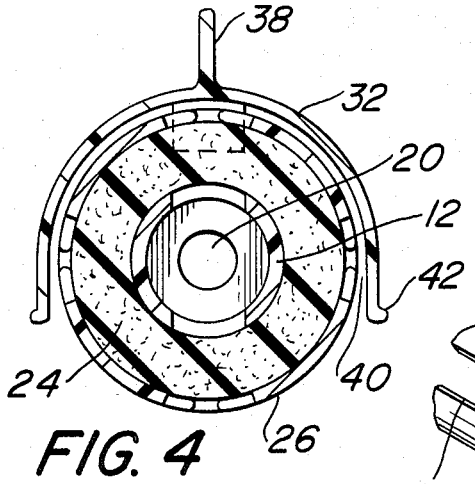
FIG. 4
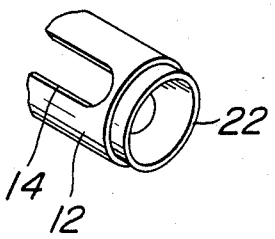
FIG. 6
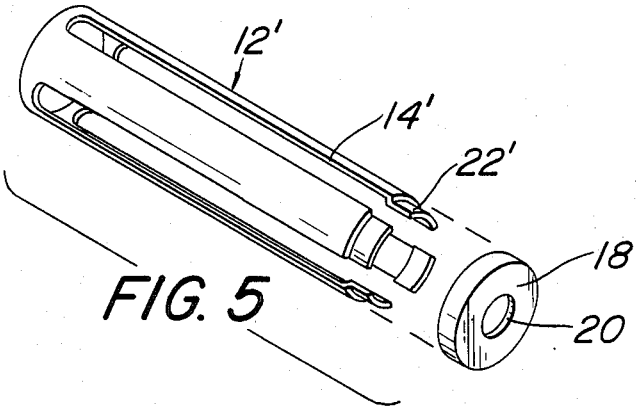
FIG. 5

FIG. 7
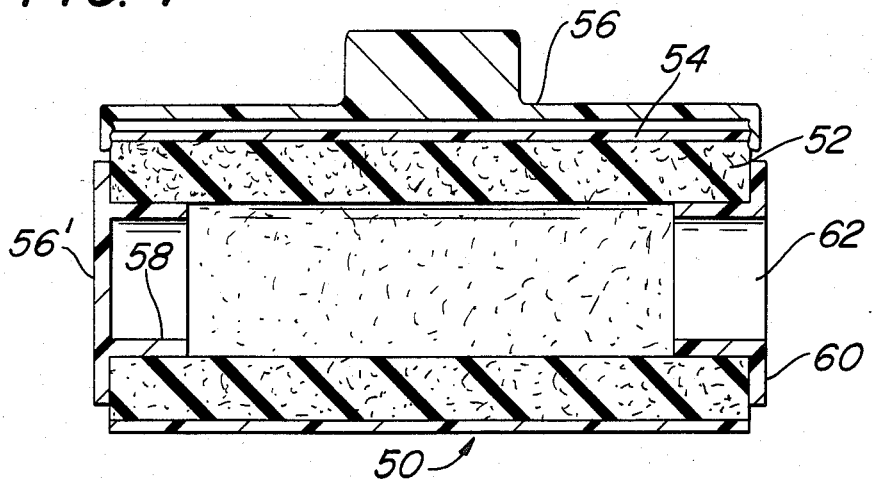
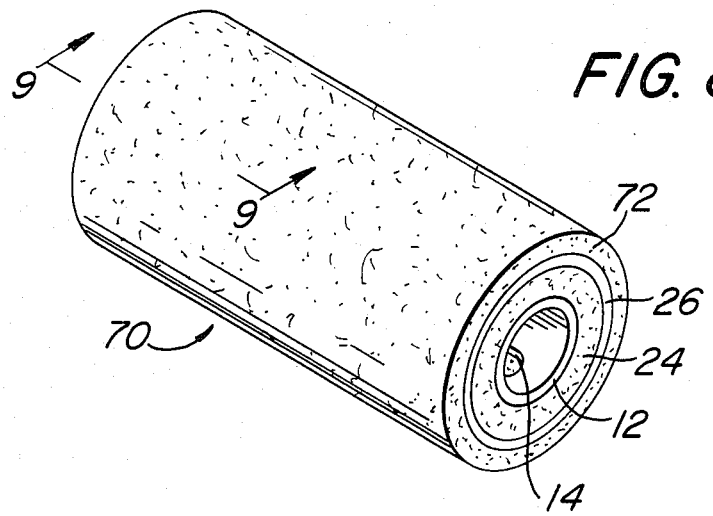
FIG. 8
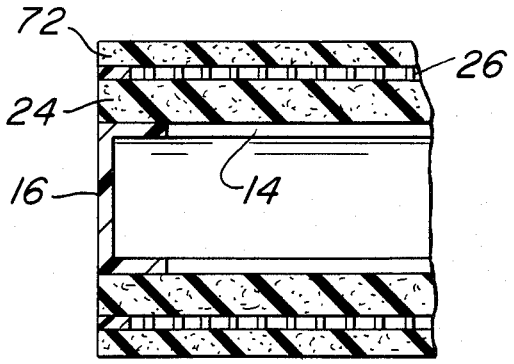
FIG. 9

STEAMABLE HAIR CURLER

BACKGROUND

Hair curlers adapted to be steamed before they are applied to hair are known. The present invention is directed to solving several problems associated with known hair curlers by reducing the number of components, rendering the components more flexible for ease of deformation to partially conform to the shape of a person's head, reducing the cost of manufacture of said hair curlers, etc.

SUMMARY OF THE INVENTION

The present invention in one embodiment is directed to a hair curler which includes a first coreless sleeve of flexible foam polymeric material closed at one end. A second more rigid sleeve surrounds the first sleeve. The second sleeve has spaced longitudinal slots on its periphery to render the central portion of the second sleeve more flexible. The other end of the first sleeve is open for receiving steam.

The hair curler preferably has the following additional features. Teeth are provided along the periphery of the slots in the second sleeve so that they may catch hair and retain the hair curler in place. A shield may be provided for removable attachment to the ends of the hair curler. The sleeve may be provided with a core which is removable whereby the first and second sleeves may be used with or without the core.

Various objects and advantages of the invention will be set forth hereinafter.

For the purposes of illustrating the invention, there is shown in the drawings a form which is presently preferred; it being understood, however, that this invention is not limited to the precise arrangements and instrumentalities shown.

FIG. 3 is a sectional view taken along the line 3—3 in FIG. 1.

FIG. 4 is a sectional view taken along the line 4—4 in FIG. 3.

FIG. 5 is an exploded view of an alternative core.

FIG. 6 is an exploded view of one end of a core.

FIG. 7 is a sectional view of another embodiment of the present invention.

FIG. 8 is a perspective view of another embodiment of the present invention.

FIG. 9 is a sectional view taken along the line 9—9 in FIG. 8.

DETAILED DESCRIPTION

Figure 1:
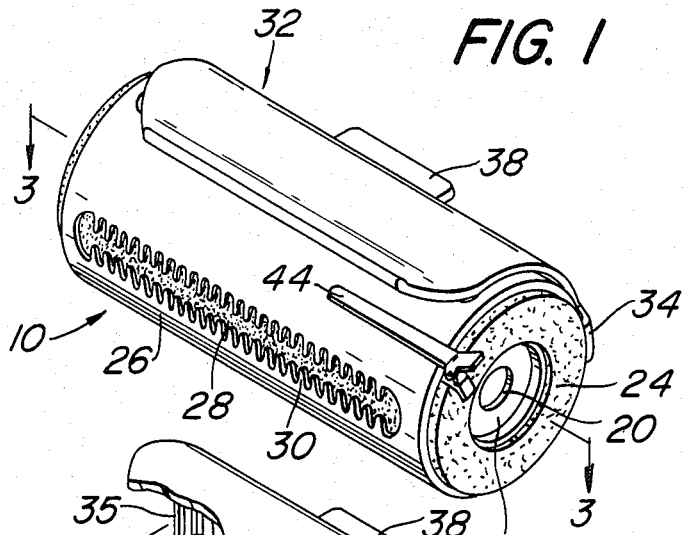
FIG. 1 is a perspective view of a hair curler in accordance with one embodiment of the present invention.
Figure 2:
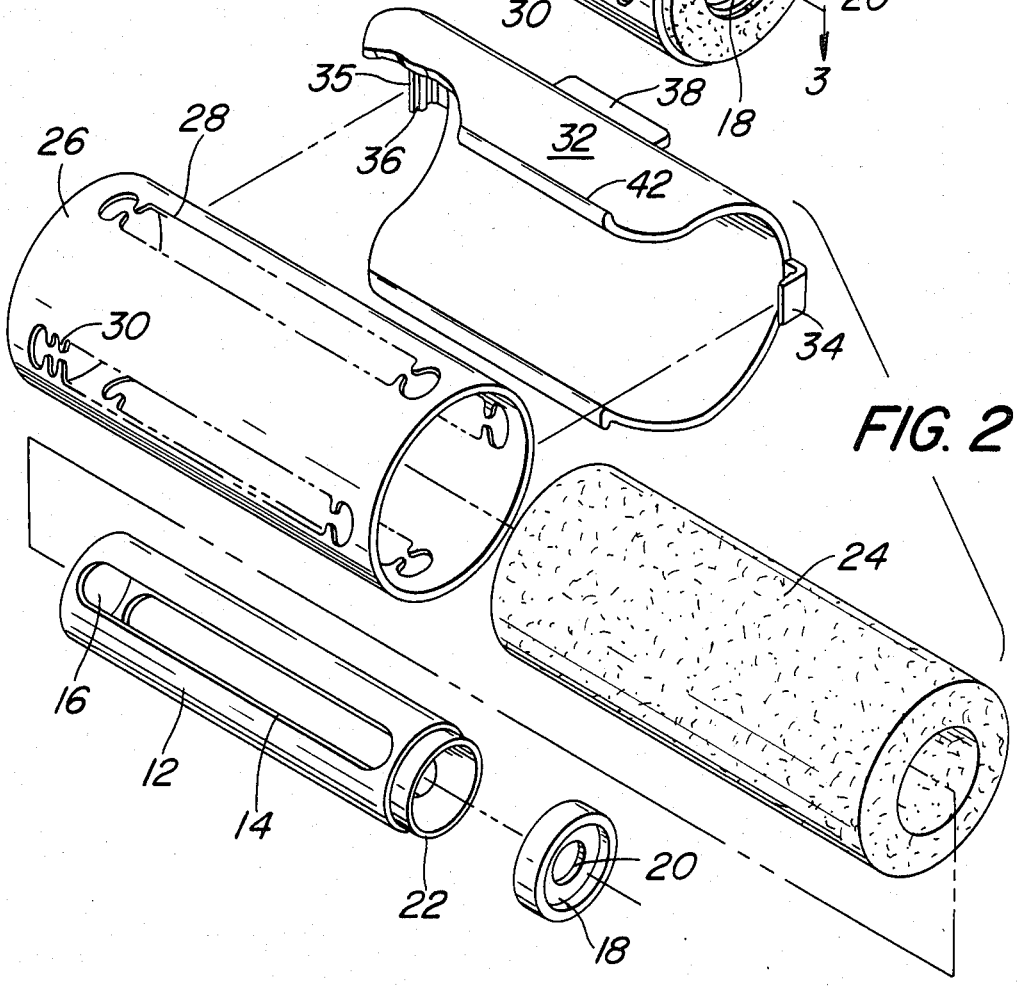
FIG. 2 is an exploded view of the components of the hair curler shown in FIG. 1.

Referring to the drawings in detail, wherein like numerals indicate like elements, there shown in FIG. 1 a perspective view of a hair curler in accordance with the present invention designated generally as 10. As shown more clearly in FIG. 2, the hair curler 10 includes an elongated core 12 which may be made from a heat conducting metal such as aluminum or from a polymer plastic material. The core 12 has longitudinally extending perforations or slots 14. Core 12 is provided with a closed end 16 having a handle 15. See FIG. 3. At its other end, core 12 is provided with a removable end cap 18. End cap 18 is adapted to be removably telescoped over a reduced diameter portion 22 at the end of the core 12 remote from the closed end 16. End cap 18 is provided with a hole 20 coaxial with the core 12. Ease of manufacture is facilitated by making end cap 18 separate from the core.

The core 12 is surrounded by a first sleeve 24 of porous material with a slight force fit therebetween. Sleeve 24 is preferably a foam polymeric plastic material whose radial thickness is substantially greater than the radial thickness of the core 12 and whose length corresponds with the length of core 12. The sleeve 24 is surrounded by second sleeve 26 with a slight force fit therebetween. Sleeve 26 is preferably made from a polymeric material impervious to liquids and is slightly shorter than sleeve 24 whereby sleeve 26 is not likely to touch a person's ear.

The sleeve 26 may have a length corresponding to the length of sleeve 24 and is substantially thinner than sleeve 24. Sleeve 26 has a plurality of holes or longitudinally extending slots 28 in its central portion. The slots 28 render the central portion of the sleeve 26 very flexible so that it may be readily deformed by minimal finger pressure to facilitate catching hair. The side edges of the slots 28 are preferably provided with a plurality of arcuately disposed fingers or teeth 30 which are adapted to catch hair when the hair curler is wound around hair. Teeth 30 catch hair and comb it. The number of slots 28 is variable. By way of example, a sleeve 26 having a diameter of approximately $1\frac{1}{4}$ inches (31 mm), I prefer to provide at least four slots 28 with the gap between oppositely disposed teeth 30 being approximately $\frac{1}{4}$ inch (6.4 mm) and the length of the teeth being approximately 3/16 inch (15 mm). Those dimensions will change on different size rollers.

A shield 32 is optionally provided and facilitates handling of the steamed curler and/or retaining hair around the curler. The shield 32 is generally C-shaped as shown more clearly in FIGS. 2 and 4. Shield 32 is provided with tabs 34 and 35 at its ends adjacent the bight. A radially outward directed handle 38 is attached to the bight on the shield 32. See FIG. 4. The inner surface of the tabs 34, 35 are provided with notches 36 to facilitate attaching the shield 32 to opposite ends of the sleeve 26. Shield 32 is slightly shorter than sleeve 26 so that the tabs 34, 35 are under tension. The notches 36 facilitate adjustment of the gap 40 between the inner periphery of shield 32 and the outer periphery of sleeve 26. See FIGS. 3 and 4. Shield 32 reduces the rapidity of heat loss whereby the curler stays warm for a longer period of time.

Steam may be introduced into the interior of core 12 by way of hole 20 in a conventional manner. If the shield 32 is utilized to support the hair curler during steaming, it is removed. Thereafter, the steamed roller is wound around hair. Thereafter, either a hair clip 44 and/or the shield 32 is applied to hold the hair around the roller in the gap 40. The flexibility of the tabs 34, 35 and the notches 36 facilitate adjustment of the gap 40 to accommodate the amount of hair wound around the roller.

The flexibility of the sleeve 26 imparted by the longitudinal slots 28 facilitates deformation of the central portion of the hair roller to approximate the curvature of the person's head. Thus, the hair curler 10 is more comfortable to a wearer since the central portion of the roller is flexible and self-accommodating to the arcuate curvature of a person's head which varies at different locations around the person's head. In addition, hair curler 10 may be utilized in connection with long hair where flexibility of the hair curler is not essential. The core 12 is totally removable before or after the hair curler 10 is wound around a person's hair. Removal of the core 12 further increases the flexibility of the hair curler 10.

In FIG. 5, there is illustrated another embodiment of the core which is designated 12'. The core 12' is identical with core 12 except as will be made hereinafter. The length of the slots 14' in the core 12' is greater than the length of the slots 14. Thus, the slots 14' extend through the reduced diameter portion 22'. This feature is a manufacturing expedient which facilitates ease of making the core 12' and facilitates ease with which the end cap 18 may be telescoped over the reduced diameter 22'.

If the particular circumstances indicate that it would be desirable not to utilize the shield 32 for retaining hair on the hair curler, hair clip 44 may be utilized to embrace a portion of hair and extend along the inner and outer surfaces of the sleeve 26. See FIG. 1.

In FIG. 7 there is illustrated a cross sectional view of another embodiment of the present invention wherein the hair curler is designated generally as 50. Hair curler 50 is identical with the hair curler 10 except as will be made hereinafter. Hair curlr 50 is coreless and includes a first flexible foam sleeve 52 corresponding to sleeve 24 which is surrounded by sleeve 54 corresponding to sleeve 26. A shield 56 which corresponds to shield 32 is attached to the ends of sleeve 52 by end tabs as described above. One end of the sleeve 52 is closed in any convenient manner. A simple and inexpensive manner for closing one end of the sleeve 52 is by way of a end cap 56' having a short boss 58 telescoped into the sleeve 52 as shown at the left hand end of FIG. 7. Alternatively, cap 56' could be cup shaped and telescoped over the outer periphery of one end of sleeve 52. If desired, the open end of the sleeve 52 may be provided with a removable end cap 60 having a hole 62 coaxial with the inner periphery of the sleeve 52. Curler 50 is utilized in the same manner as described above.

The hair curler 50 is lighter in weight and cheaper to manufacture than the hair curler 10. In addition, the lack of a core renders the hair curler 10 more flexible and comfortable. Excluding the shield, hair curler 10 has a weight of approximately 15 grams whereas hair curler 50 without the shield may have a weight of 7 to 8 grams.

In FIG. 8, there is illustrated another embodiment of the present invention wherein the hair curler is designated generally as 70. The hair curler 70 is identical with the hair curler 10, except as follows. A sleeve 72 is telescoped over the sleeve 26 and has a length corresponding to the length of sleeve 26. Sleeve 72 is preferably a layer of foam polymer plastic material corresponding to the material of sleeve 24. Sleeve 72 is preferably thinner than the radial thickness of the sleeve 24. The relative thickness of sleeves 24 and 72 may be different as desired. The provision of the sleeve 72 renders the curler 70 with longer heat retension than hair curler 10 while permitting wrapping hair therearound without feeling the higher temperature within the roller. In addition, sleeve 72 spaces the hair to be curled from the sleeve 26 so as to prevent the application of moisture which may condense on sleeve 26 when the steam is very hot and/or wet. Sleeve 72 is removable and utilized to convert hair curler 10 to hair curler 70 when the condition of the steam warrants the same. Hair curler 70 is otherwise identical with hair curler 10.

Figure 10:
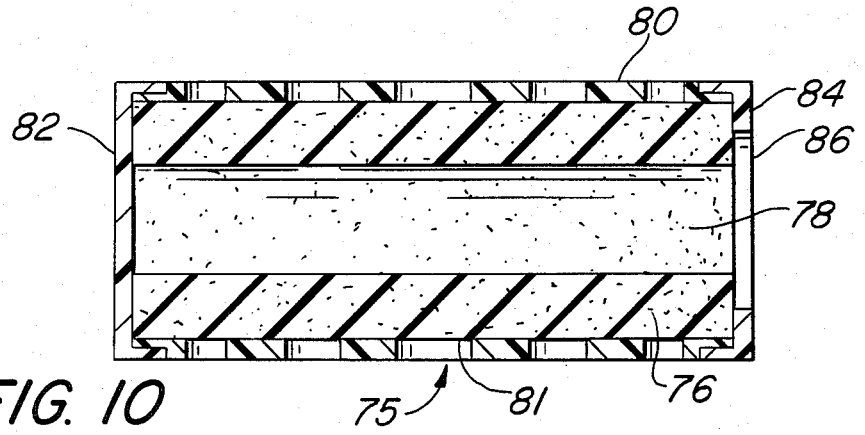
FIG. 10 is a sectional view of another embodiment.

In FIG. 10 there is illustrated another embodiment of a hair curler designated 75. Curler 75 is coreless and includes a sleeve 76 of foam polymeric plastic. The bore of sleeve 76 is designated 78. Sleeve 76 is telescoped into perforated sleeve 80 with a slight interference fit. Perforations 81 in sleeve 80 may be of larger diameter adjacent the central portion than adjacent the ends thereof. Sleeve 80 is made from a polymeric plastic impervious to liquids and has a reduced thickness at its ends.

A first plastic end cap 82 is snapped onto the reduced thickness of sleeve 80 and closes one of sleeve 76. A second plastic end cap 84 is snapped onto the reduced thickness at the other end of sleeve 80. End cap 84 has a hole 86 coaxial with bore 78. Hole 86 has a diameter greater than that of bore 78. In addition to its simplicity and low cost, roller 75 is readily usable by unskilled persons and can be attached to hair wound therearound by a detachable clip similar to clip 44.

Figure 11:
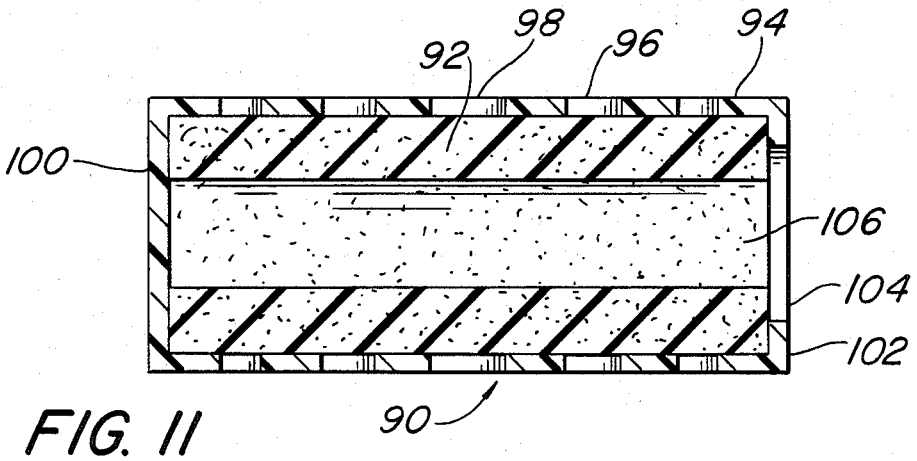
FIG. 11 is a sectional view of another embodiment.

In FIG. 11 there is illustrated another embodiment of a corelss hair curler designated 90. Curler 90 includes a sleeve 92, like sleeve 76, telescoped into a sleeve 94. Sleeve 94 is the same as sleeve 80 but is integral in one piece with end wall 100. Sleeve 94 has rows of holes with holes 96 being smaller in diameter than holes 98 so the central portion of sleeve 94 is more flexible. At the end of sleeve 94 remote from wall 100, there is provided radially inwardly directed flange 102 terminating at hole 104 coaxial with bore 106 in sleeve 92. The diameter of hole 104 is greater than the diameter of bore 106 but less than the diameter of sleeve 94.

Roller 90 is comprised of only two components. The hole 104 is sufficiently large so that the sleeve 92 may be deformed and then insertd into sleeve 94. A few drops of hair conditioner may be introduced into sleeve 92 while it is in sleeve 94. Sleeve 94 will distribute the hair conditioner so that it is picked up by steam and distributed to the hair which is wound therearound.

Figure 12:
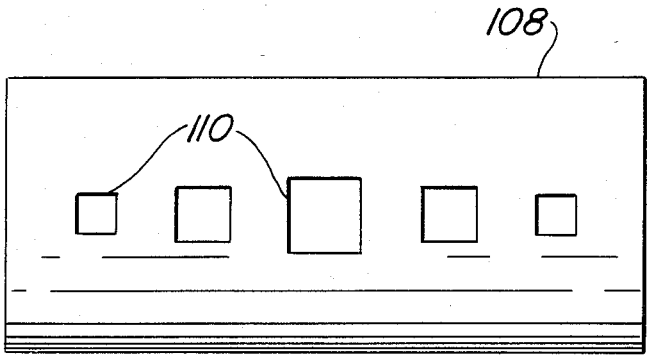
FIG. 12 is a plan view of a sleeve.

In FIG. 12 there is illustrated a sleeve 108 having circumferentially rows of holes 110. Holes 110 are larger in the central portion than near the ends of the sleeve. Hence the central portion is more flexible. This method of attaining flexibility may be used in the other embodiments discussed above in connection wtih sleeves 26, 54, 80, 94, each of which is impervious to liquids and more rigid than the foam plastic sleeve associated therewith.

Figure 13:
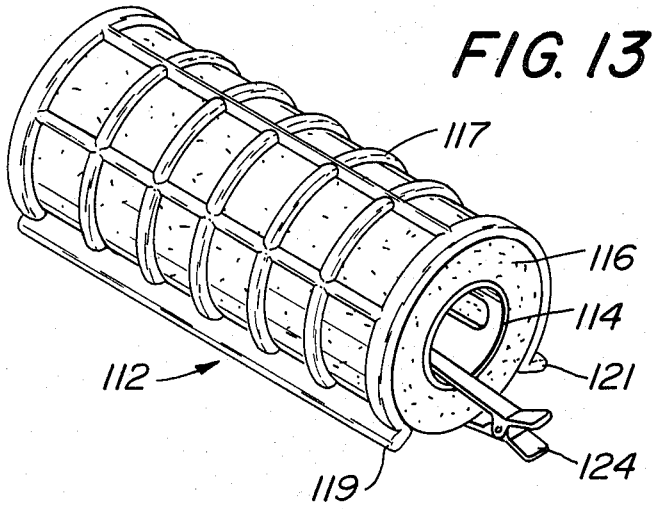
FIGS. 13 and 14 are perspective views of another embodiment.
Figure 14:
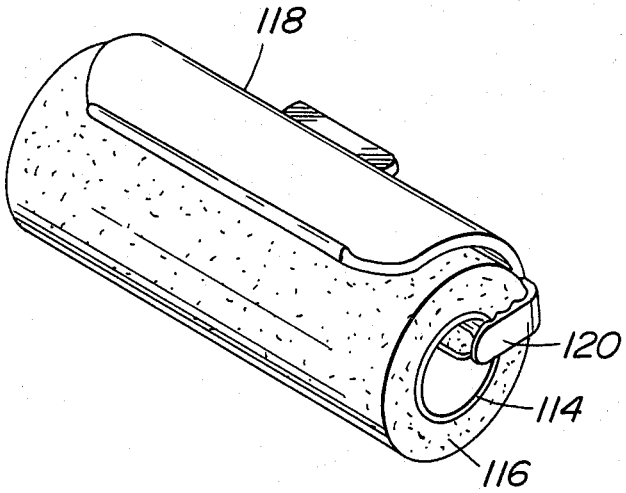

In FIGS. 13 and 14 there is illustrated another embodiment of a hair curler designated generally as 112. Curler 112 is the same as curler 10 except as follows. Curler 112 has a removably core 114 having slots like core 12, and over which is telescoped a sleeve 116. Sleeve 116 is like sleeve 24 and has a slight force fit. Curler 112 does not have a sleeve corresponding to sleeve 26. Curler 112 may have a shield 117 which lacks a handle and which relies on deformation of the foam plastic sleeve 116 to facilitate attachment. Shield 117 is not connected to sleeve 116 or core 114 by any tabs. Shield 117 is made of plastic and has flexible free ends 119, 121. Shield 117 embraces about 200° to 270° of the circumference of sleeve 116 and has a large number of open areas for escape of steam.

Alternatively, curler 112 may have a shield 118 as shown in FIG. 14.

The shield 118 is like shield 32 but the tabs 120 are longer so that they cooperate with the ends of core 114. If desired, shield 118 may have longitudinally extending slots. Curler 112 may be attached to hair by a clip 124 which is like clip 44. Curler 112 has less parts and is less expensive than curler 10.

Each curler lends itself to use with a clip such as clip 44. Each curler has an opening at one end for introducing steam thereinto. Each curler is more flexible in its central portion as compared with its ends.

The present invention may be embodied in other specific forms without departing from the spirit or essential attributes thereof and, accordingly, reference should be made to the appended claims, rather than to the foregoing specification, as indicating the scope of the invention.

I claim:

1. A hair curler comprising a first coreless hollow sleeve of flexible foam plastic material closed at one end, a second sleeve surrounding said first sleeve, said second sleeve having spaced longitudinally extending aperture means around its periphery to render the central portion of the second sleeve flexible, the other end of said first sleeve being arranged to receive steam.

2. A hair curler in accordance with claim 1 wherein said aperture means are having therefor oppositely disposed teeth along the opposite edges of said slots.

3. A hair curler in accordance with claim 2 wherein said teeth are arcuate and correspond to the circumference of the second sleeve.

4. A hair curler in accordance with claim 1 including a shield removably attached to the opposite ends of the second sleeve and having its inner surface spaced from the outer surface of the second sleeve.

5. A hair curler in accordance with claim 1 wherein said one end of the first sleeve is closed by a removable end cap.

6. A hair curler comprising a first sleeve of flexible foam plastic material closed at one end and open at its other end for receiving steam, said sleeve being closed at said one end by a removable core having longitudinally extending slots, a second sleeve surrounding said first sleeve, said second sleeve having longitudinally extending slots spaced around its periphery to render the central portion of the second sleeve flexible.

7. A hair curler in accordance with claim 6 wherein said core has an outer diameter which is slightly greater than the inner diameter of said first sleeve so as to provide a force-fit while permitting removal of the core by finger pressure.

8. A hair curler in accordance with claim 6 including a third sleeve telescoped over said second sleeve, said third sleeve being a foam plastic material whose radial thickness is thinner than that of the first sleeve.

9. A hair curler in accordance with claim 6 wherein said slots of said second sleeve have arcuate teeth for catching hair.

10. A hair curler in accordance with claim 6 wherein the axial length of said first sleeve is slightly greater than the axial length of said second sleeve.

11. A steamable hair curler comprising:

a porous foam plastic hollow sleeve surrounded by a second sleeve of more rigid material impervious to liquids, said second sleeve being substantially thinner than said first sleeve, the inner diameter of said second sleeve being slightly smaller than the outer diameter of said first sleeve so as to provide an interference fit therebetween, said second sleeve having a plurality of openings in its central portion to render the said portion flexible so that it may deform inwardly and assume a concave shape and through which steam may escape, and means closing only one end of the bore in said first mentioned sleeve, the other end of said bore being arranged to receive steam.

12. A hair curler in accordance with claim 11 including a perforated core removably disposed within said bore and being said closing means.

13. A hair curler in accordance with claim 12 wherein said core has an outer periphery which enables the core to be removable from either end of said bore.

14. A hair curler in accordance with claim 11 wherein said second sleeve has an end wall integral in one piece therewith, said end wall being said closing means.

15. A hair curler in accordance with claim 14 including drops of hair conditioner in said first sleeve.

16. A hair curler in accordance with claim 11 wherein said closing means is an end cap attached to the outer periphery of said second sleeve.

17. A steamable hair curler comprising a hollow sleeve of foam plastic, a hollow core having its outer periphery of uniform diameter and telescoped into said sleeve with an interference fit, said core being made from a liquid impervious material and having a plurality of aperatures in a central portion thereof to facilitate escape of steam in a radical direction, said core being closed at one end and having an opening st its other end for receiving steam, said core and sleeve having substantially the same length.

18. A hair curler in accordance with claim 17 including a shield removably attached to the ends of said core by radially disposed members, said shield being spaced from the outer periphery of said sleeve so that hair to be curled may be disposed therebetween.

19. A hair curler in accordance with claim 17 including a shield attached to the sleeve outer periphery by deformation of the sleeve, said shield having an opening for escape of steam and embracing 200° to 270° of the circumference of said sleeve.

20. A steamable hair curler in accordance with claim 11 including a porous foam plastic sleeve removably telescoped over said second sleeve to increase the heat retention of the hair curler.

* * * * *